US006906689B2

(12) United States Patent
Lee et al.

(10) Patent No.: US 6,906,689 B2
(45) Date of Patent: Jun. 14, 2005

(54) PLASMA DISPLAY PANEL AND DRIVING METHOD THEREOF

(75) Inventors: Jae Koo Lee, Pohang-shi (KR); Hyun Chul Kim, Kwangju-shi (KR); Sung Soo Yang, Kwangju-shi (KR); Young Kyo Shin, Seoul-shi (KR)

(73) Assignee: LG Electronics Inc., Seoul (KR)

( * ) Notice: Subject to any disclaimer, the term of this patent is extended or adjusted under 35 U.S.C. 154(b) by 391 days.

(21) Appl. No.: 10/121,617

(22) Filed: Apr. 15, 2002

(65) Prior Publication Data

US 2002/0154074 A1 Oct. 24, 2002

(30) Foreign Application Priority Data

Apr. 18, 2001 (KR) ..... 2001-20614
Apr. 18, 2001 (KR) ..... 2001-20615

(51) Int. Cl.[7] ..... G09G 3/28

(52) U.S. Cl. ..... 345/60; 345/66; 345/67; 345/68; 313/582; 313/585

(58) Field of Search ..... 345/60, 62, 66, 345/68, 61, 63, 64, 65, 67; 313/582–587

(56) References Cited

U.S. PATENT DOCUMENTS 6,295,040 B1 * 9/2001 Nhan et al. ..... 345/60
6,384,531 B1 * 5/2002 Park et al. ..... 313/584
6,483,491 B1 * 11/2002 Lee ..... 345/60
6,621,215 B1 * 9/2003 Su et al. ..... 313/582

FOREIGN PATENT DOCUMENTS

KR 2000-74476 12/2000
KR 2002-72791 9/2002

* cited by examiner

*Primary Examiner*—Dennis-Doon Chow
(74) *Attorney, Agent, or Firm*—Fleshner & Kim LLP

(57) ABSTRACT

A plasma display panel that is adaptive for improving discharge efficiency. In the panel, a plurality of the first and second electrodes are provided at the rear side of an upper substrate. A dielectric layer is provided at the rear side of the upper substrate in such a manner to cover the upper substrate and the first and second electrodes. A plurality of the first and second auxiliary electrodes are provided in parallel to the first and second electrodes within the dielectric layer.

22 Claims, 14 Drawing Sheets

PLASMA DISPLAY PANEL AND DRIVING METHOD THEREOF

BACKGROUND OF THE INVENTION

1. Field of the Invention

This invention relates to a plasma display panel, and more particularly to a plasma display panel that is adaptive for improving discharge efficiency.

2. Description of the Related Art

Generally, a plasma display panel (PDP) is a display device utilizing a visible light emitted from a Phosphor layer when an ultraviolet ray generated by a gas discharge excites the Phosphor layer. The PDP has an advantage in that it has a thinner thickness and a lighter weight in comparison to the existent cathode ray tube (CRT) and is capable of realizing a high resolution and a large-scale screen. The PDP includes of a plurality of discharge cells arranged in a matrix pattern, each of which makes one pixel of a field.

FIG. 1 is a perspective view showing a discharge cell structure of a conventional three-electrode, alternating current (AC) surface-discharge PDP.

Referring to FIG. 1, a discharge cell of the conventional three-electrode, AC surface-discharge PDP includes the first electrode 12Y and the second electrode 12Z provided on an upper substrate 10, and an address electrode 20X provided on a lower substrate 18.

Each of the first electrode 12Y and the second electrode 12Z is a transparent electrode made from indium-tin-oxide (ITO). Since the ITO has a high resistance value, the rear sides of the first and second electrodes 12Y and 12Z are provided with bus electrodes 13Y and 13Z made from a metal, respectively. The bus electrodes 13Y and 13Z supply a driving signal from the exterior to the first and second electrodes 12Y and 12Z, thereby applying a uniform voltage to each discharge cell.

On the upper substrate 10 provided with the first electrode 12Y and the second electrode 12Z in parallel, an upper dielectric layer 14 and a protective layer 16 are disposed. Wall charges generated upon plasma discharge are accumulated into the upper dielectric layer 14. The protective layer 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a Phosphor layer 26. The address electrode 20X is formed in a direction crossing the first electrode 12Y and the second electrode 12Z.

The barrier rib 24 is formed in parallel to the address electrode 20X to prevent an ultraviolet ray and a visible light generated by a discharge from being leaked to the adjacent discharge cells. The Phosphor layer 26 is excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24.

Such a PDP drives one frame, which is divided into various sub-fields having a different discharge frequency, so as to express gray levels of a picture. Each sub-field is again divided into an initialization period for uniformly causing a discharge, an address period for selecting the discharge cell and a sustain period for realizing the gray levels depending on the discharge frequency. For instance, when it is intended to display a picture of 256 gray levels, a frame interval equal to 1/60 second (i.e. 16.67 msec) is divided into 8 sub-fields SF1 to SF8 as shown in FIG. 2. Each of the 8 sub-fields SF1 to SF8 is divided into an address period and a sustain period. Herein, the initialization period and the address period of each sub-field are equal at every sub-field, whereas the sustain period are increased at a ratio of $2^n$ (wherein n=0, 1, 2, 3, 4, 5, 6 and 7) at each sub-field.

FIG. 3 is a waveform diagram of a driving signal applied to each electrode of the conventional PDP.

Referring to FIG. 3, one sub-field is divided into an initialization period for initializing the entire field, an address period for writing a data while scanning the entire field on a line-sequence basis, and a sustain period for sustaining an emission state of the cells into which a data is written.

The first, in the initialization period, an initialization waveform RP is applied to the first electrodes Y. If so, an initialization discharge is generated between the first electrodes Y and the second electrodes Z to initialize the discharge cells. At this time, a misfiring prevention pulse is applied to the address electrodes X.

In the address period, a scan pulse −Vs is sequentially applied to the first electrodes Y. A data pulse Vd synchronized with the scan pulse −Vs is applied to the address electrodes X. At this time, an address discharge is generated at the discharge cells to which the data pulse Vd and the scan pulse −Vs are applied.

In the sustain period, the first and second sustain pulses SUSPy and SUSPz are applied to the first and second electrodes Y and Z. At this time, a sustain discharge is generated at the discharge cells which have generated the address discharge, to thereby display a desired picture on the PDP.

FIG. 4 is a detailed view showing a structure of the first and second electrodes provided on the upper substrate of the PDP.

Referring to FIG. 4, each of the first and second electrodes 12Y and 12Z provided on the upper substrate 10 of the PDP have a width of about 390 μm. The first and second electrodes 12Y and 12Z are formed on the upper substrate 10 at a space of about 60 μm. Further, a distance extending from the first and second electrodes 12Y and 12Z until a boundary portion of the discharge cell is set to be about 210 μm. In other words, the conventional first and second electrodes 12Y and 12Z are provided at the center of the discharge cell. Thus, a sustain discharge generated between the first electrode 12Y and the second electrode 12Z concentrates on the center of the discharge cell. If the sustain discharge concentrates on the center of the discharge cell, then a utility of a discharge space is deteriorated and hence a discharge efficiency is deteriorated.

In order to solve this problem, a space between the first electrode 12Y and the second electrode 12Z may be set widely. In other words, if a space between the first electrode 12Y and the second electrode 12Z is widened, then a discharge path can be lengthened to improve discharge efficiency.

However, a widened space between the first electrode 12Y and the second electrode 12Z causes a rise of a firing voltage and a discharge sustaining voltage to thereby increase total driving voltage.

SUMMARY OF THE INVENTION

Accordingly, it is an object of the present invention to provide a plasma display panel and a driving method that is adaptive for improving discharge efficiency.

In order to achieve these and other objects of the invention, a plasma display panel according to one aspect of the present invention includes a plurality of the first and second electrodes provided at the rear side of an upper substrate; a dielectric layer provided at the rear side of the upper substrate in such a manner to cover the upper substrate and the first and second electrodes; and a plurality of the first and second auxiliary electrodes provided in parallel to the first and second electrodes within the dielectric layer.

In the plasma display panel, the first and second auxiliary electrodes are provided at the edge of the discharge cell.

The first auxiliary electrode overlaps with the first electrode and the second auxiliary electrode overlaps with the second electrode.

Each of the first and second auxiliary electrodes has a narrower width than each of the first and second electrodes.

The widths of the first and second auxiliary electrodes are set to 10 $\mu$m to 80 $\mu$m. The widths of the first and second auxiliary electrodes are preferably set to 40 $\mu$m.

The first auxiliary electrode is spaced at 10 $\mu$m to 40 $\mu$m from the first electrode and the second auxiliary electrode is spaced at 10 $\mu$m to 40 $\mu$m from the second electrode. The first auxiliary electrode is preferably spaced at 40 $\mu$m from the first electrode, and the second auxiliary electrode is preferably spaced at 40 $\mu$m from the second electrode.

The first auxiliary electrode is electrically connected to the first electrode, and the second auxiliary electrode is electrically connected to the second electrode.

A plasma display panel according to another aspect of the present invention includes a plurality of the first and second electrodes provided at the rear side of an upper substrate; and auxiliary electrodes provided between the first and second electrodes.

In the plasma display panel, the width of the auxiliary electrode is set to 60 $\mu$m to 140 $\mu$m. The width of the auxiliary electrode is preferably set to 100 $\mu$m.

The auxiliary electrode is spaced at 60 $\mu$m to 100 $\mu$m from the first and second electrodes.

A method of driving a plasma display panel according to still another aspect of the present invention includes the steps of alternately applying the first and second sustain pulses to first and second electrodes in a sustain period; and applying a first auxiliary pulse synchronized with the first and second sustain pulses to an auxiliary electrode.

The method further includes the steps of applying a second auxiliary pulse between the first sustain pulses; and applying a third auxiliary pulse between the second sustain pulses in such a manner to be alternated with the second auxiliary pulse.

In the method, the second auxiliary pulse is applied simultaneously with the first auxiliary pulse supplied between the first sustain pulses, and the third auxiliary pulse is applied simultaneously with the first auxiliary pulse supplied between the second sustain pulses.

The first to third auxiliary pulses have the same pulse width.

The first to third auxiliary pulses have narrower pulse widths than the first and second sustain pulses.

Said pulse widths of the first to third auxiliary pulses are set to 0.5 $\mu$m to 1.5 $\mu$m. Preferably, said pulse widths of the first to third auxiliary pulses are set to 0.6 $\mu$m to 1.0 $\mu$m.

The first auxiliary pulse has a voltage value of −150V to −170V. Preferably, Each of the second and third auxiliary pulses has a voltage value of 50V to 60V.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
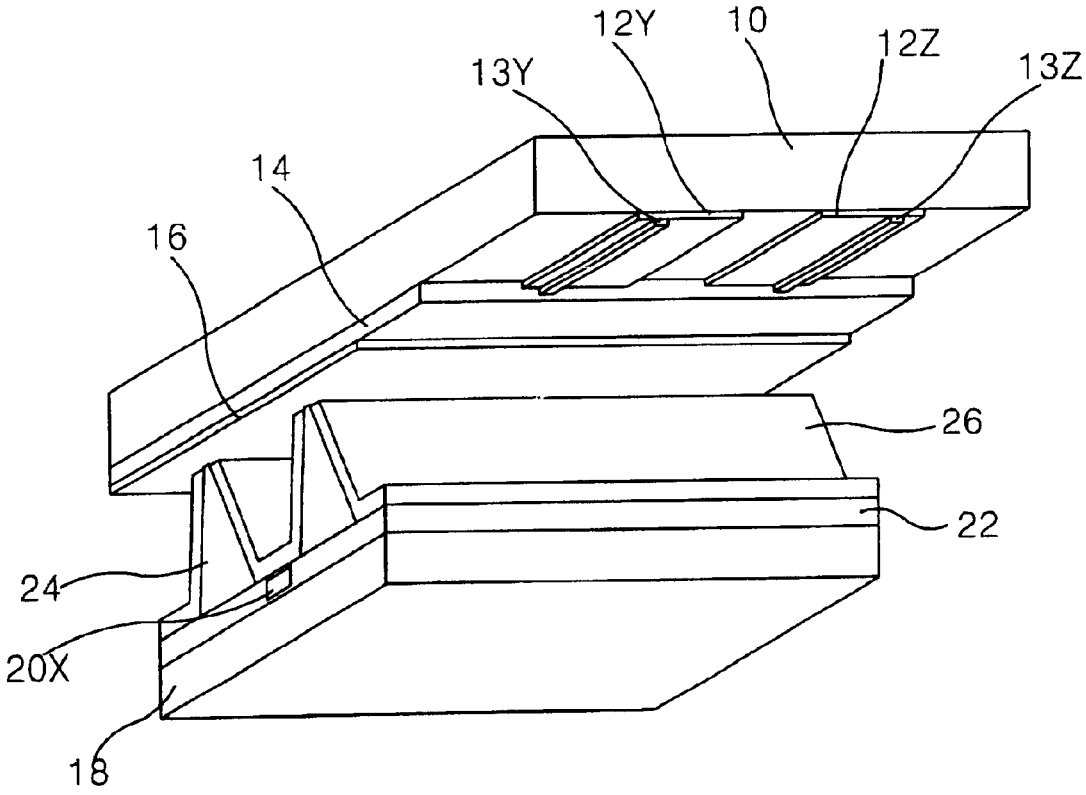
FIG. 1 CONVENTIONAL ART
FIG. 1 is a perspective view showing a discharge cell structure of a conventional AC surface-discharge plasma display panel.
Figure 2:
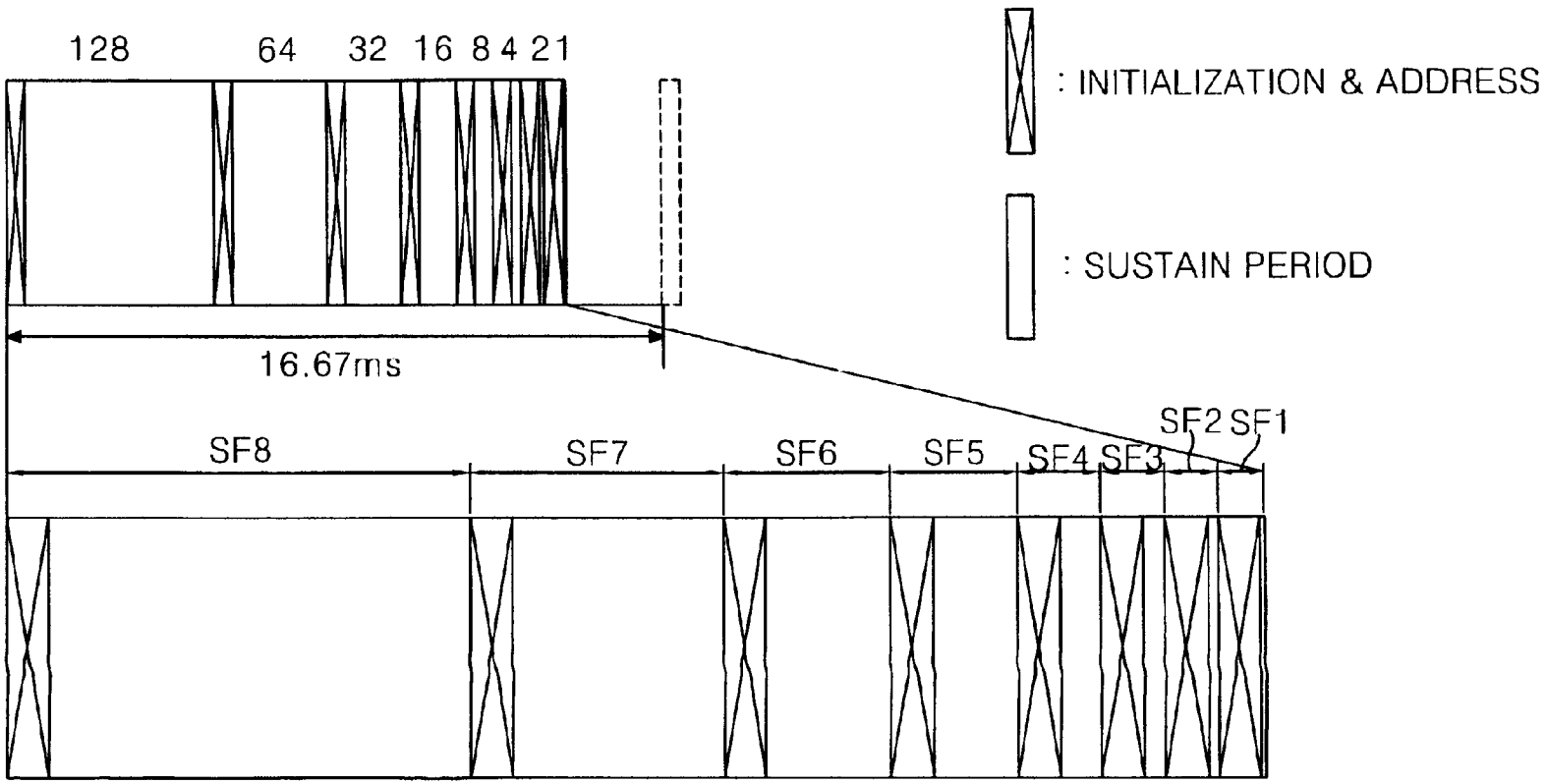
FIG.2 CONVENTIONAL ART
FIG. 2 depicts gray levels of one frame of the plasma display panel shown in FIG. 1.
Figure 3:
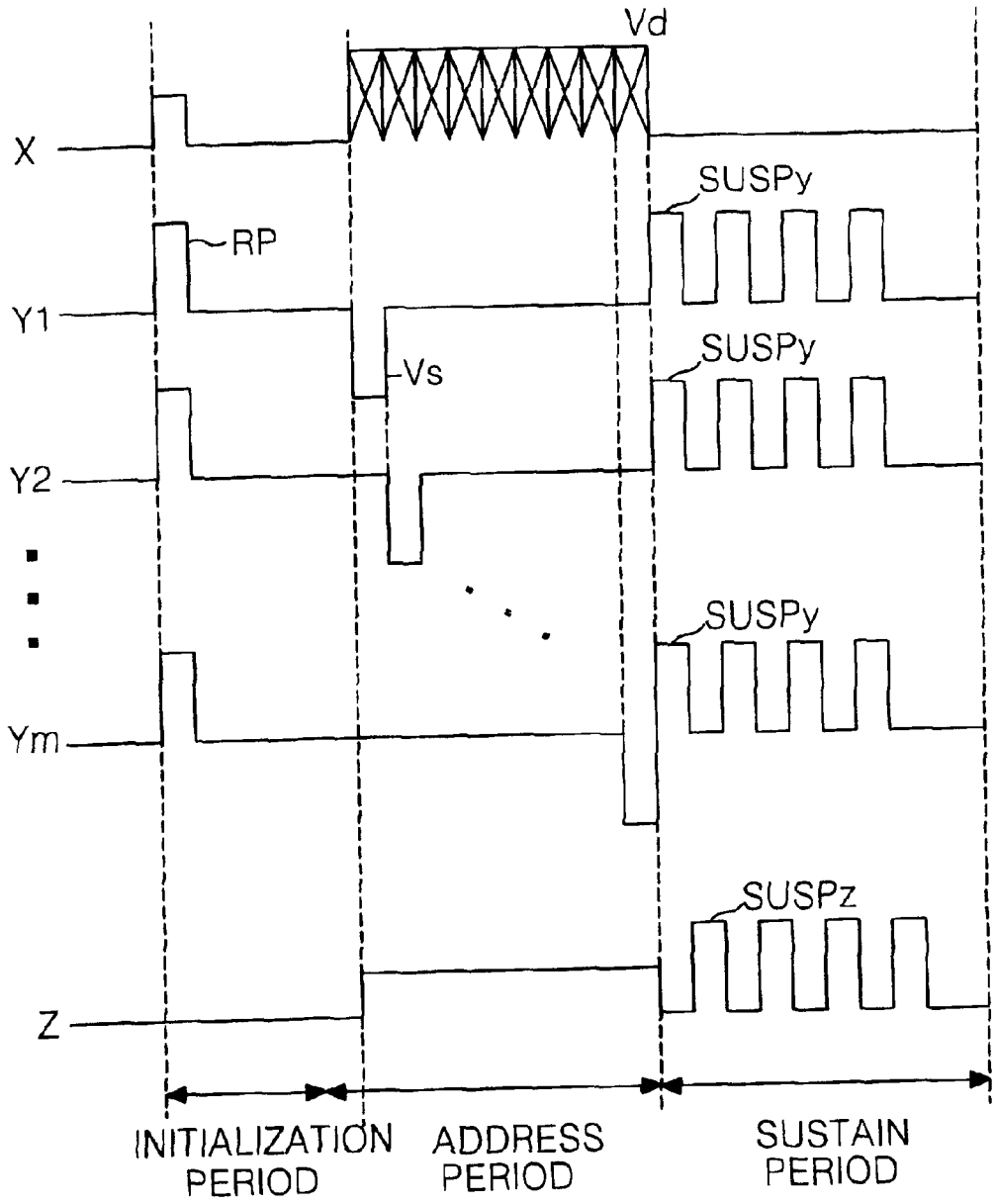
FIG. 3 CONVENTIONAL ART
FIG. 3 is a waveform diagram of a driving signal applied to each electrode of the plasma display panel for each sub-field.
Figure 4:
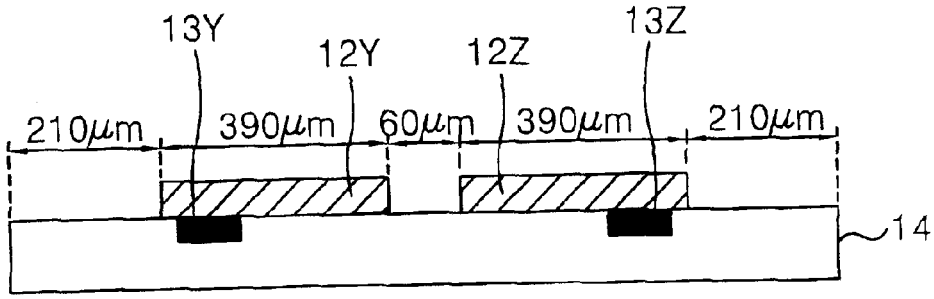
FIG. 4 CONVENTIONAL ART
FIG. 4 is a detailed view showing a structure of the electrodes provided on the upper substrate.
Figure 5:
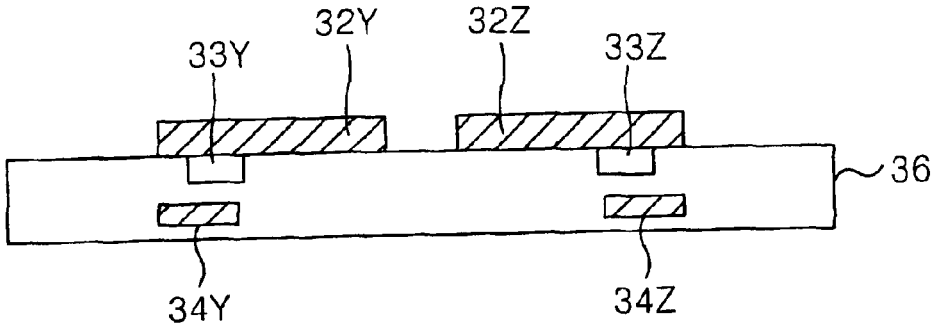
FIG. 5 illustrates electrodes provided on an upper substrate of a plasma display panel according to the first embodiment of the present invention.

FIG. 5 shows an upper substrate of a plasma display panel (PDP) according to the first embodiment of the present invention.

Referring to FIG. 5, the upper substrate of the PDP is provided with the first and second electrodes 32Y and 32Z. Each of the first and second electrodes 32Y and 32Z is a transparent electrode made from ITO. Since the ITO has a high resistance value, the rear sides of the first and second electrodes 32Y and 32Z are provided with bus electrodes 33Y and 33Z made from a metal, respectively. The bus electrodes 33Y and 33Z supply a driving signal from the exterior to the first and second electrodes 32Y and 32Z to thereby apply a uniform voltage to each discharge cell.

On the upper substrate provided with the first electrode 32Y and the second electrode 32Z in parallel, an upper dielectric layer 36 are disposed. Wall charges generated upon plasma discharge are accumulated into the upper dielectric layer 36. A protective layer (not shown) is provided on the upper dielectric layer 36.

First and second auxiliary electrodes 34Y and 34Z are provided within the upper dielectric layer 36. The first auxiliary electrode 34Y is formed at the edge of the discharge cell in such a manner to overlap with the first electrode 32Y. The second auxiliary electrode 34Z is formed at the edge of the discharge cell in such a manner to overlap with the second electrode 32Z.

The first and second auxiliary electrodes 32Y and 32Z allow a sustain discharge to be generated at the entire discharge cell. To this end, the first auxiliary electrode 34Y is electrically connected to the first electrode 32Y while the second auxiliary electrode 34Z is electrically connected to the second electrode 32Z.

In other words, the same voltage as the first electrode 32Y is applied to the first auxiliary electrode 34Y, whereas the same voltage as the second electrode 32Z is applied to the second auxiliary electrode 34Z. Accordingly, a voltage at the edge of the discharge cell becomes higher than a voltage at the center of the discharge cell in the sustain period. If so, a sustain discharge is generated entirely without concentrating on the center of the discharge cell to thereby improve discharge efficiency.

Figure 6:
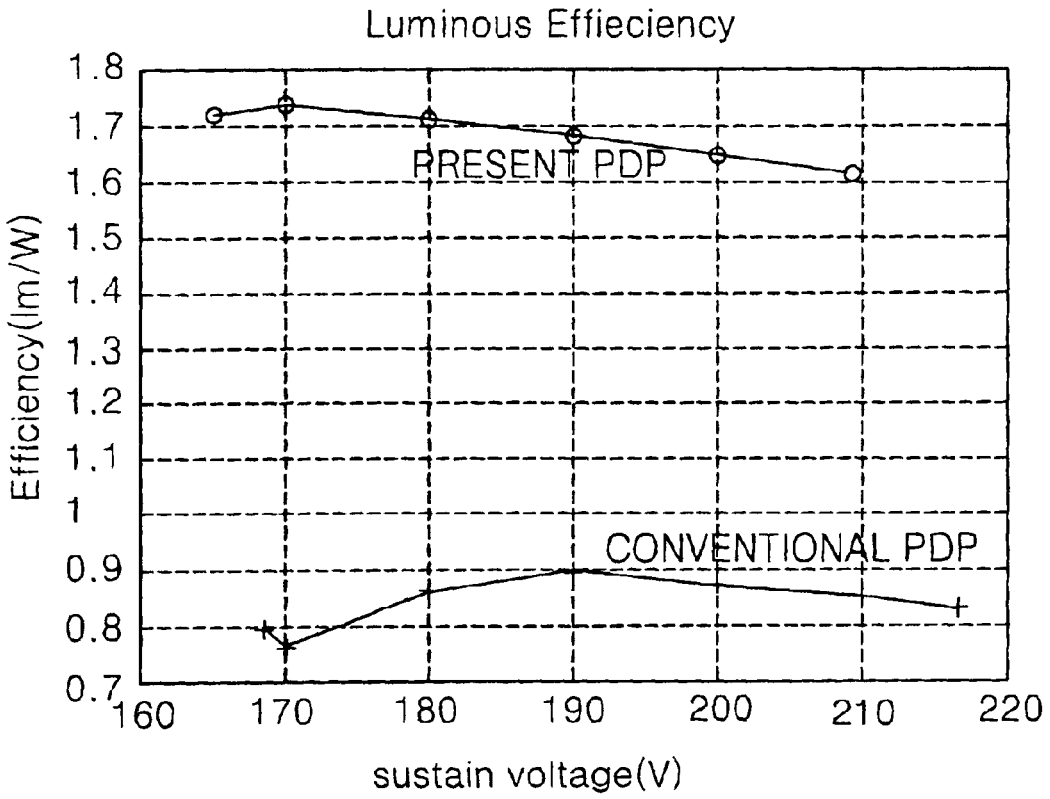
FIG. 6 is a graph representing an efficiency of the plasma display panel.

For instance, the PDP according to the first embodiment has a higher efficiency than the conventional PDP as shown in FIG. 6. In FIG. 6, the X axis represents a sustain voltage value applied to the first and second electrodes 32Y and 32Z while the Y axis does an efficiency value obtained by dividing brightness by power consumption. As can be seen from FIG. 6, the PDP according to the first embodiment has a higher efficiency (i.e., improvement of about 90%) than the conventional PDP.

Figure 7:
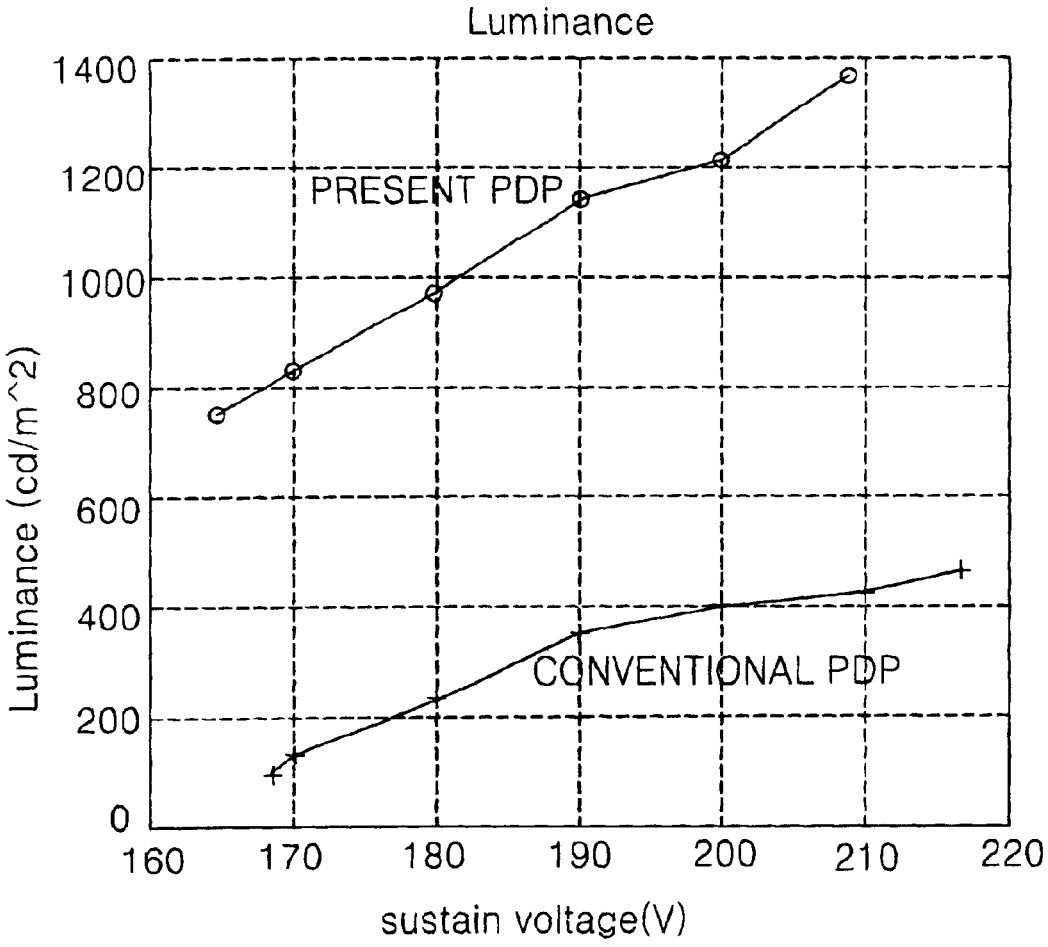
FIG. 7 is a graph representing a brightness value of the plasma display panel.

FIG. 7 is a graph representing a brightness value of the PDP according to the first embodiment of the present invention.

Referring to FIG. 7, the PDP according to the first embodiment has a higher brightness value than the conventional PDP. Herein, the X axis represents a sustain voltage value applied to the first and second electrodes 32Y and 32Z while the Y axis does a brightness value of the PDP. In the PDP according to the first embodiment, a brightness rises in accordance with a rise in a sustain voltage value as shown in FIG. 7. Further, the PDP according to the first embodiment when a voltage of 170V is applied to the first and second electrodes 32Y and 32Z has about 400 cd/m$^2$ higher brightness value than the conventional PDP when a voltage of 200V is applied. Accordingly, the PDP according to the first embodiment can be driven with a low voltage.

Figure 8:
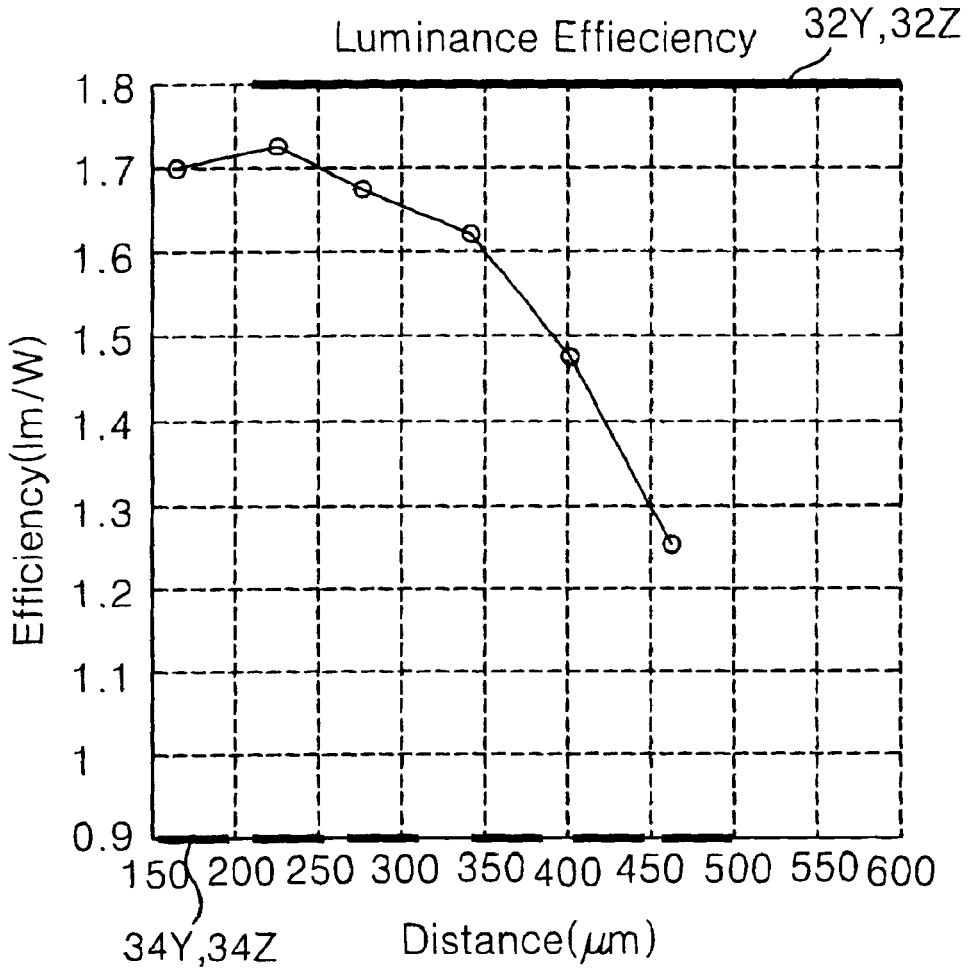
FIG. 8 is a graph representing an efficiency of the plasma display panel according to positions of the auxiliary electrodes shown in FIG. 5.

FIG. 8 is a graph representing an efficiency value depending upon positions of the auxiliary electrodes of the PDP according to the first embodiment of the present invention.

Referring to FIG. 8, as the first and second auxiliary electrodes 34Y and 34Z go into the center of the discharge cell, an efficiency of the PDP is lowered. Otherwise, as the first and second auxiliary electrodes 34Y and 34Z go into the edge of the discharge cell, an efficiency of the PDP is increased. Meanwhile, if the first and second auxiliary electrodes 34Y and 34Z do not overlap with the first and second electrodes 32Y and 32Z, then an efficiency of the PDP is lowered. Therefore, the first and second auxiliary electrodes 34Y and 34Z are provided to overlap with the first and second electrodes 32Y and 32Z.

Figure 9:
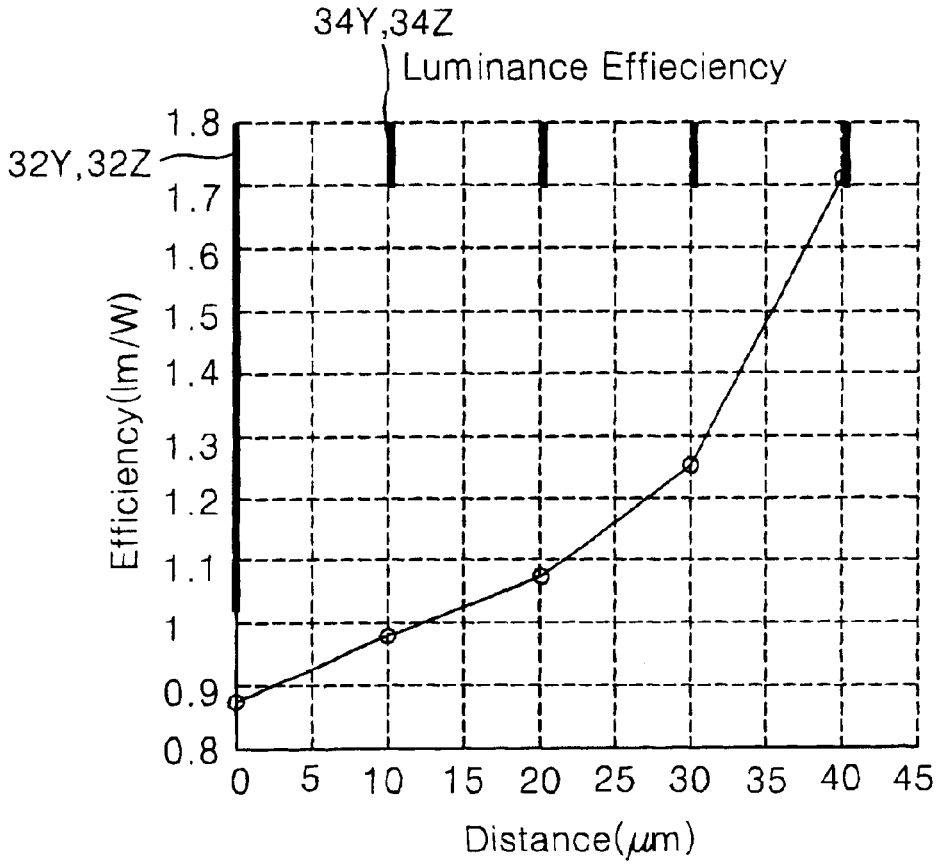
FIG. 9 is a graph representing an efficiency of the plasma display panel according to a space between the auxiliary electrodes and the first and second electrodes shown in FIG. 5.

FIG. 9 is a graph representing an efficiency value depending upon a space between the auxiliary electrodes and the first and second electrodes of the PDP according to the first embodiment of the present invention.

Referring to FIG. 9, as a distance between the first and second auxiliary electrodes 34Y and 34Z and the first and second electrodes 32Y and 32Z go wider, an efficiency of the PDP is increased. Thus, when the upper dielectric layer 36 is formed at a thickness of 45 $\mu$m, the first and second auxiliary electrodes 34Y and 34Z is spaced at a distance of above 40 $\mu$m from the first and second electrodes 32Y and 32Z.

Figure 10:
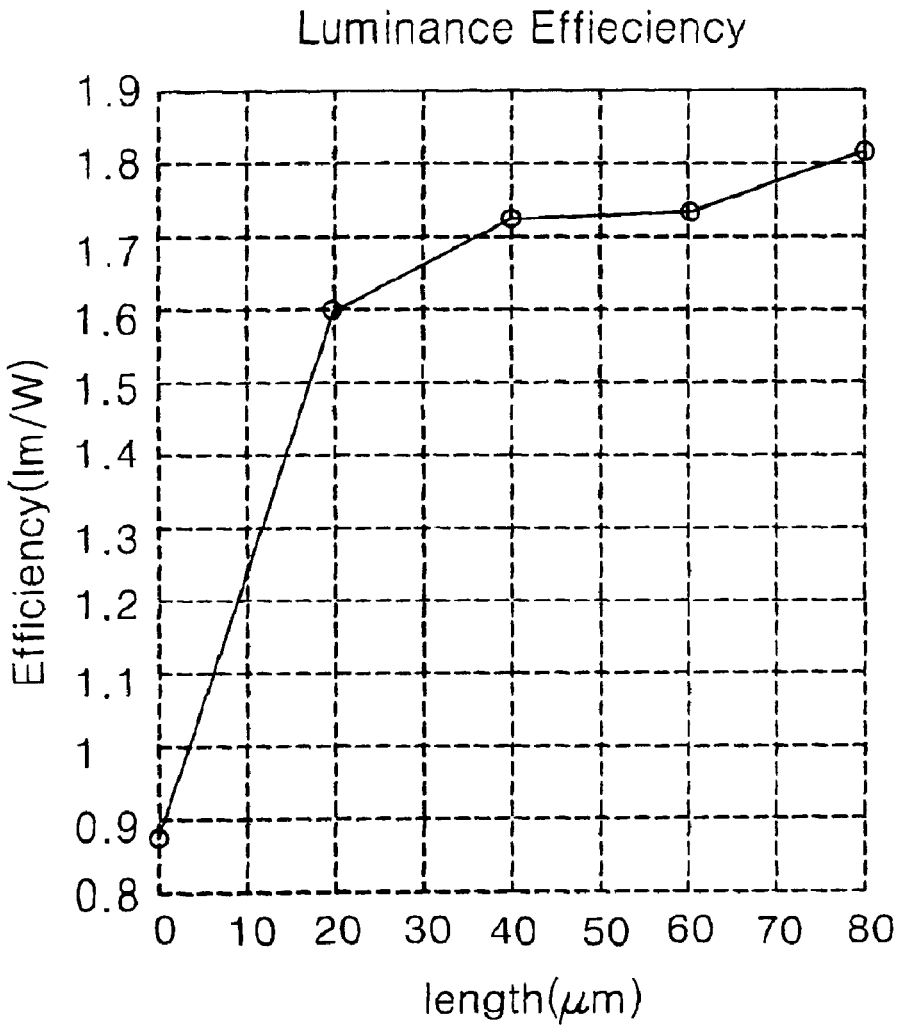
FIG. 10 is a graph representing an efficiency of the plasma display panel according to widths of the auxiliary electrodes shown in FIG. 5.

FIG. 10 is a graph representing an efficiency value depending upon widths of the auxiliary electrodes of the PDP according to the first embodiment of the present invention.

Referring to FIG. 10, it can be seen that, as the first and second auxiliary electrodes 34Y and 34Z go wider, an efficiency of the PDP is increased. In other words, the efficiency of the present PDP suddenly rises until the widths of the first and second auxiliary electrodes 34Y and 34Z are 40 $\mu$m, and slowly rises after they are 40 $\mu$m. Meanwhile, as the widths of the first and second auxiliary electrodes 34Y and 34Z go wider, the greater power is wasted. Thus, the first and second auxiliary electrodes 34Y and 34Z are set to be about 40 $\mu$m.

Figure 11:
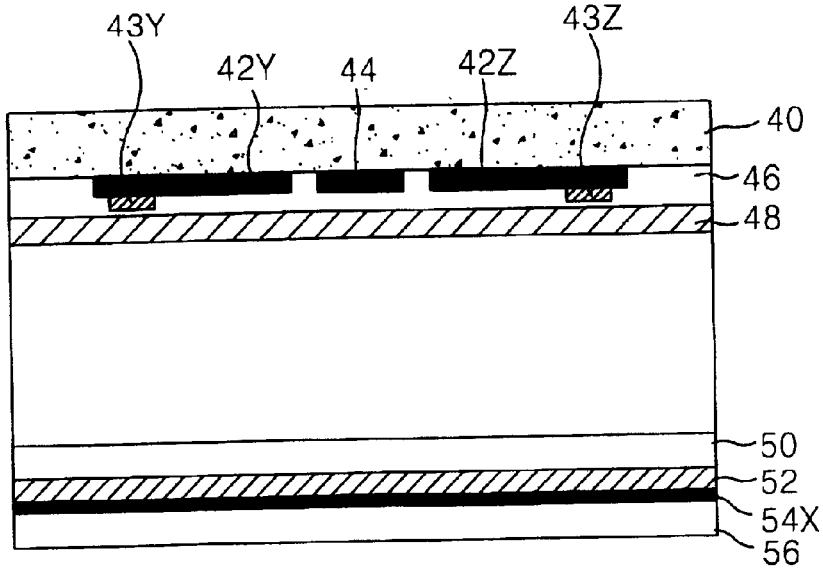
FIG. 11 illustrates a discharge cell structure of a plasma display panel according to a second embodiment of the present invention.

FIG. 11 shows a discharge cell structure of a plasma display panel according to a second embodiment of the present invention.

Referring to FIG. 11, the PDP according to the second embodiment includes the first electrode 42Y and a second electrode 42Z provided on an upper substrate 40, and an address electrode 54X provided on a lower substrate 56.

Each of the first and second electrodes 42Y and 42Z is a transparent electrode made from ITO. Since the ITO has a high resistance value, the rear sides of the first and second electrodes 42Y and 42Z are provided with bus electrodes 43Y and 43Z made from a metal, respectively. The bus electrodes 43Y and 43Z supply a driving signal from the exterior to the first and second electrodes 42Y and 42Z to thereby apply a uniform voltage to each discharge cell. Between the first electrode 42Y and the second electrode 42Z, an auxiliary electrode 44 is provided in parallel to the first and second electrodes 42Y and 42Z.

On the upper substrate 40 provided with the first electrode 42Y and the second electrode 42Z in parallel, an upper dielectric layer 46 and a protective film 48 are disposed. Wall charges generated upon plasma discharge are accumulated into the upper dielectric layer 46. The protective layer 48 prevents a damage of the upper dielectric layer 46 caused by a sputtering during the plasma discharge and improves the emission efficiency of secondary electrons. This protective layer 48 is usually made from magnesium oxide (MgO).

A lower dielectric layer 52 and barrier ribs (not shown) are formed on the lower substrate 56 provided with the address electrode 54X. The surfaces of the lower dielectric layer 52 and the barrier ribs are coated with a Phosphor layer 50. The address electrode 54X is formed in a direction crossing the first electrode 42Y and the second electrode 42Z.

Figure 12:
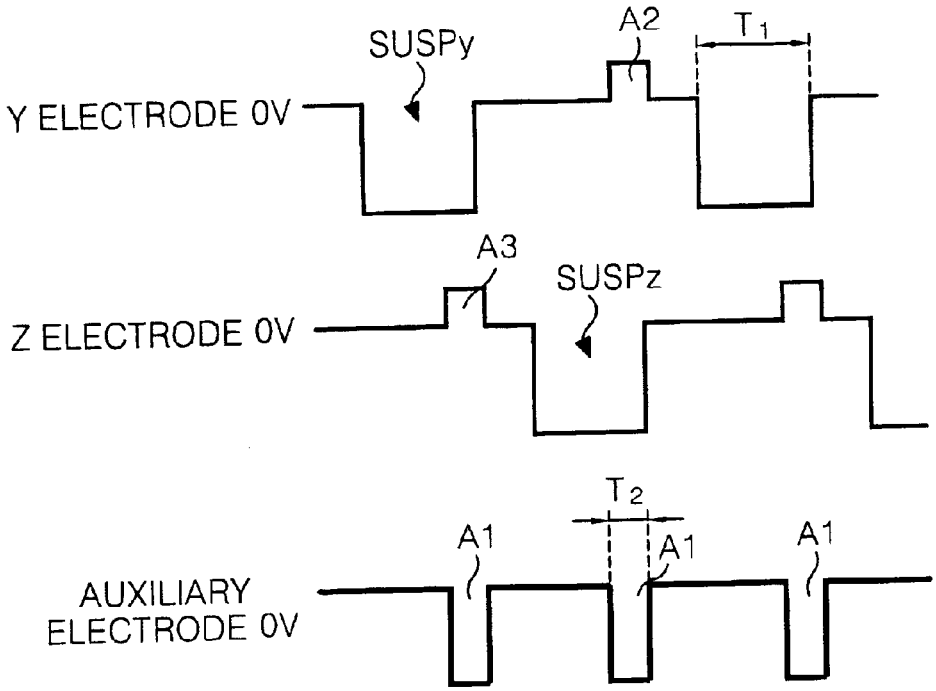
FIG. 12 is a waveform diagram of a driving signal applied to each electrode shown in FIG. 11 in the sustain period.

FIG. 12 is a waveform diagram of driving signals applied to the auxiliary electrode, the first electrode and the second electrode in the sustain period in the PDP according to the second embodiment of the present invention.

Referring to FIG. 12, the first and second sustain pulses SUSPy and SUSPZ are alternately applied to the first and second electrodes 42Y and 42Z. Whenever the first and second sustain pulses SUSPy and SUSPz are applied to the first and second electrodes 42Y and 42Z, the first auxiliary pulse A1 is applied to the auxiliary electrode 44.

Further, a second auxiliary pulse A2 is applied to the first electrode 42Y between the first sustain pulses SUSPy. A third auxiliary pulse A3 is applied to the second electrode 42Z between the second sustain pulses SUSPz.

These second and third auxiliary pulses A2 and A3 are alternately supplied with being synchronized with the first auxiliary pulse A1.

The first auxiliary pulse A1, the second auxiliary pulse A2 and the third auxiliary pulse A3 have the same pulse width T2. Each of the first, second and third auxiliary pulses A1, A2 and A3 has a pulse width of about 0.5 to 1.5 $\mu$s, and has preferably a pulse width of about 0.6 to 1.0 $\mu$s. The first and second sustain pulses SUSPy and SUSPz have a wider pulse width T1 than the first to third auxiliary pulses A1 to A3. The pulse width T1 of the sustain pulses SUSPy and SUSPz is set to be about 3 $\mu$s. Meanwhile, a voltage of the first auxiliary pulse A1 is set to a range of −150V to −170V, and voltages of the second and third auxiliary pulses A2 and A3 are set to a range of 50V to 60V.

Hereinafter, a sustain operation of the PDP according to the second embodiment of the present invention with reference to FIG. 13A to FIG. 13C.

Figure 13A:
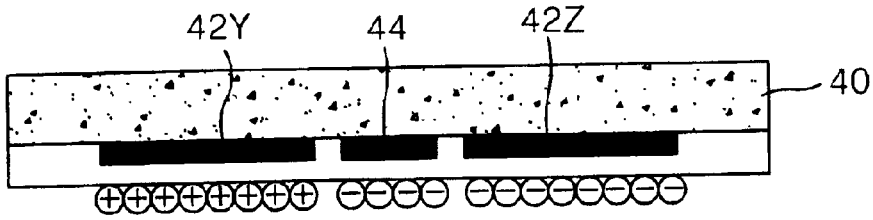
FIG. 13A to FIG. 13C represents wall charges formed at the discharge cell when the driving waveform shown in FIG. 12 is applied.

The first, it is assumed that, as shown in FIG. 13A, positive wall charges are formed at the first electrode 42Y while negative wall charges are formed at the second electrode 42Z and the auxiliary electrode 44. Then, a negative the first auxiliary pulse A1 is applied to the auxiliary electrode 44.

Figure 13B:
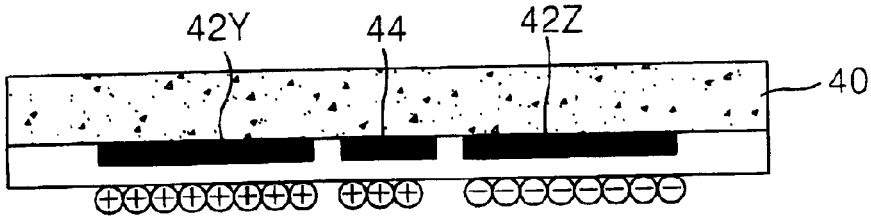

If a negative first auxiliary pulse A1 is applied to the auxiliary electrode 44, then positive wall charges are formed at the auxiliary electrode 44 as shown in FIG. 13B. At this time, a positive third auxiliary pulse A3 is applied to the second electrode 42Z. Thus, negative wall charges formed at the second electrode 42Z are kept or enhanced.

Subsequently, a negative second sustain pulse SUSPz is applied to the second electrode 42Z. If a negative second sustain pulse SUSPz is applied to the second electrode 42Z, then a discharge is generated between the second electrode 42Z and the auxiliary electrode 44. In other word, since positive wall charges are formed at the auxiliary electrode 44, a discharge is initiated between the auxiliary electrode 44 and the second electrode 42Z. Then, a sustain discharge is generated between the first electrode 42Y and the second electrode 42Z.

The PDP according to the second embodiment forms positive wall charges at the auxiliary electrode 44, so that it can cause a sustain discharge between the first electrode 42Y and the second electrode 42Z. In other words, the present PDP forms positive wall charges at the auxiliary electrode 44, so that it may cause a sustain discharge between the first electrode 42Y and the second electrode 42Z by a low voltage.

Figure 13C:
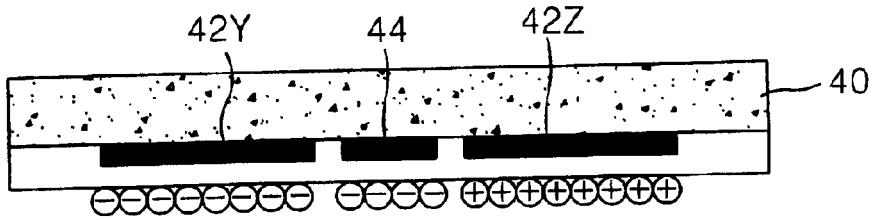

If a sustain discharge occurs between the first electrode 42Y and the second electrode 42Z, then negative wall charges are formed at the first electrode 42Y, positive wall charges are formed at the second electrode 42Z, and negative wall charges are formed at the auxiliary electrode 44, as shown in FIG. 13C. Then, a negative first auxiliary pulse A1 is applied to the auxiliary electrode 44 to form positive wall charges. The present PDP repeats a process as mentioned above to generate a sustain discharge.

Figure 14:
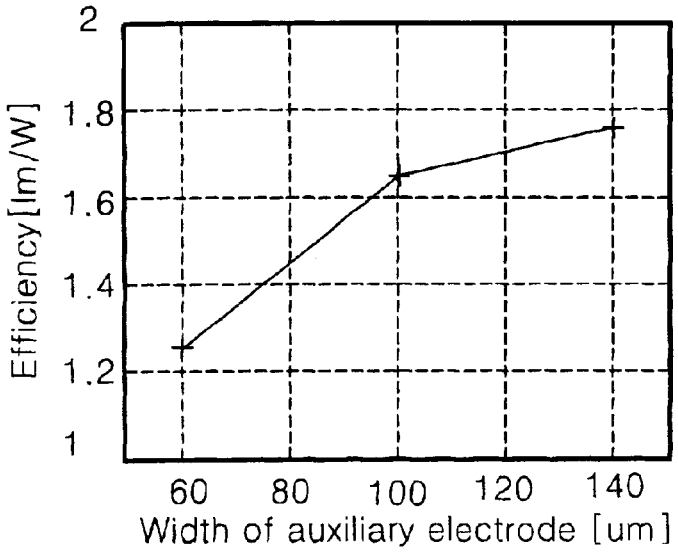
FIG. 14 is a graph representing an efficiency of the plasma display panel according to width of the auxiliary electrode shown in FIG. 11.

FIG. 14 is a graph representing an efficiency value according to a width of the auxiliary electrode.

It can be seen from FIG. 14 that, as a width of the auxiliary electrode 44 goes wider, an efficiency of the PDP is increased. Herein, the X axis represents a width of the auxiliary electrode 44 while the Y axis does an efficiency value obtained by dividing brightness by power consumption. At this time, a space between the auxiliary electrode 44 and the first and second electrodes 42Y and 42Z is fixed to 60 $\mu$m, and a distance extending from the first and second electrodes 42Y and 42Z until the boundary portion of the discharge cell is fixed to 220 $\mu$m. Accordingly, as a width of the auxiliary electrode 44 goes wider, widths of the first and second electrodes 42Y and 42Z are reduced.

In the mean time, as shown in FIG. 14, an efficiency of the PDP is suddenly increased when a width of the auxiliary electrode 44 is increased from 60 $\mu$m into 100 $\mu$m; whereas it is slowly increased when a width of the auxiliary electrode 44 is increased from 100 $\mu$m into 140 $\mu$m. Thus, in the present embodiment, a width of the auxiliary electrode 44 is set to 60 $\mu$m to 140 $\mu$m, and is preferably set to 100 $\mu$m.

Figure 15:
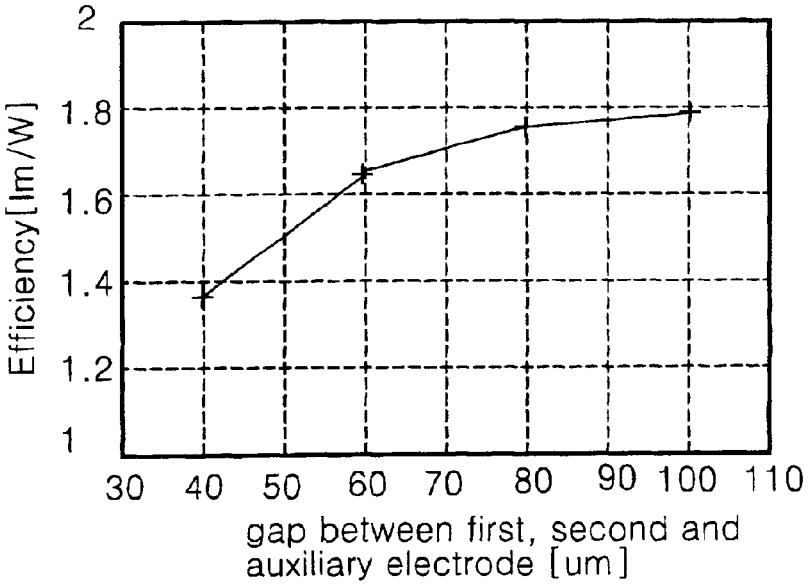
FIG. 15 is a graph representing an efficiency value of the plasma display panel according to a space between the auxiliary electrode and the first and second electrodes shown in FIG. 11.

FIG. 15 is a graph representing an efficiency value according a space between the auxiliary electrode and the first and second electrodes.

It can be seen from FIG. 15 that, as a space between the auxiliary electrode 44 and the first and second electrodes 42Y and 42Z goes wider, an efficiency of the PDP is increased. Herein, the Y axis represents an efficiency of the PDP while the X axis does a space between the auxiliary electrode 44 and the first and second electrodes 42Y and 42Z. A width of the auxiliary electrode 44 is fixed to 100 $\mu$m, and a distance extending from the first and second electrodes 42Y and 42Z until the boundary portion of the discharge cell is fixed to 220 $\mu$m. Thus, as a space between the auxiliary electrode 44 and the first and second electrodes 42Y and 42Z goes wider, widths of the first and second electrodes 42Y and 42Z are reduced.

As can be seen from FIG. 15, an efficiency of the PDP is suddenly increased when a space between the auxiliary electrode 44 and the first and second electrodes 42Y and 42Z is increased from 40 $\mu$m into 60 $\mu$m; whereas it is slowly increased when a space between the auxiliary electrode 44 and the first and second electrodes 42Y and 42Z is increased from 60 $\mu$m into 100 $\mu$m. In the present embodiment, a space between the auxiliary electrode 44 and the first and second electrodes 42Y and 42Z is set to 60 $\mu$m to 100 $\mu$m.

Figure 16:
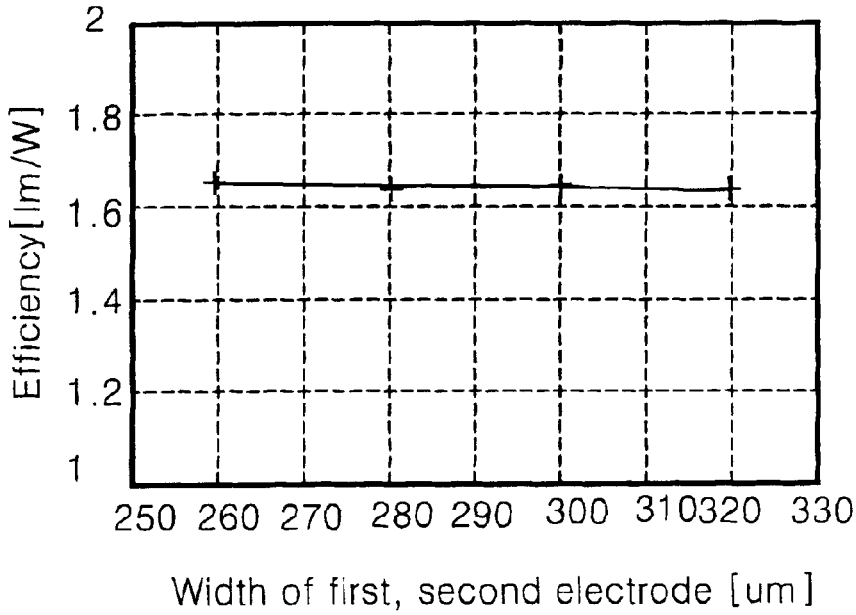
FIG. 16 is a graph representing an efficiency value of the plasma display panel according to widths of the first and second electrodes shown in FIG. 11.

FIG. 16 is a graph representing an efficiency value according to widths of the first and second electrodes.

It can be seen from FIG. 16 that an efficiency of the PDP is almost constant independently of widths of the first and second electrodes 42Y and 42Z. Herein, the X axis represents widths of the first and second electrodes 42Y and 42Z while the Y axis does an efficiency of the PDP. At this time, a width of the auxiliary electrode 44 is fixed to 100 $\mu$m while a space between the auxiliary electrode 44 and the first and second electrodes 42Y and 42Z is fixed to 60 $\mu$m.

Figure 17:
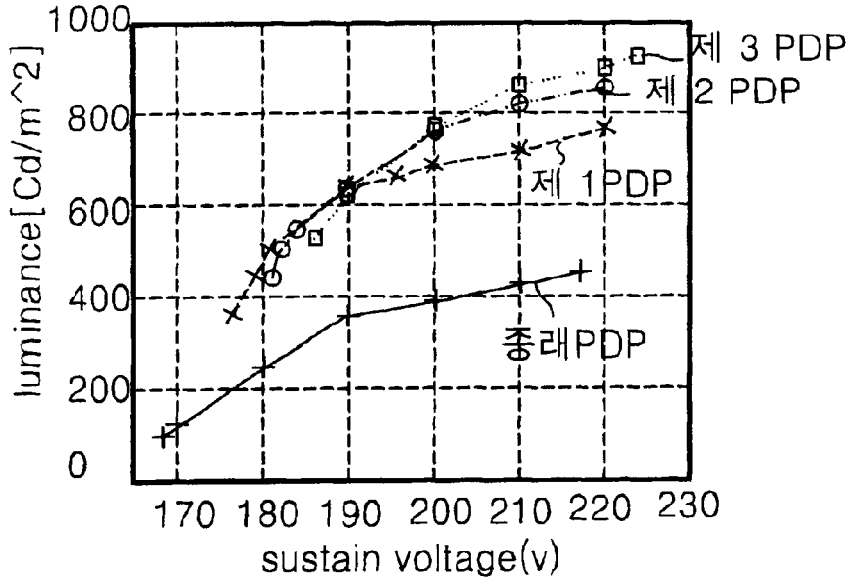
FIG. 17 is a graph for comparing a brightness value of the conventional plasma display panel with that of the plasma display panel according to the second embodiment of the present invention.
Figure 18:
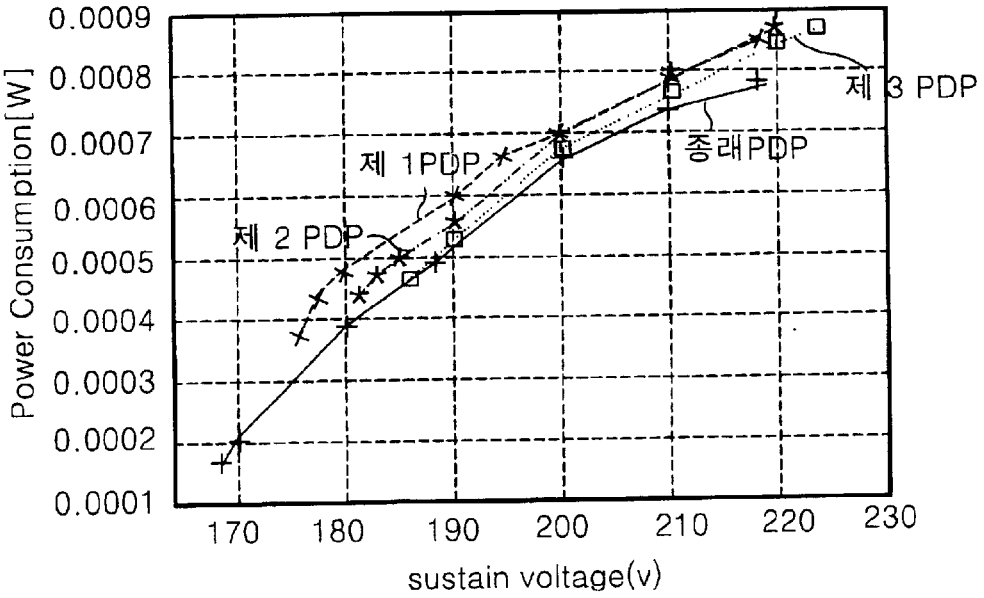
FIG. 18 is a graph for comparing power consumption of the conventional plasma display panel with that of the plasma display panel according to the second embodiment of the present invention.
Figure 19:
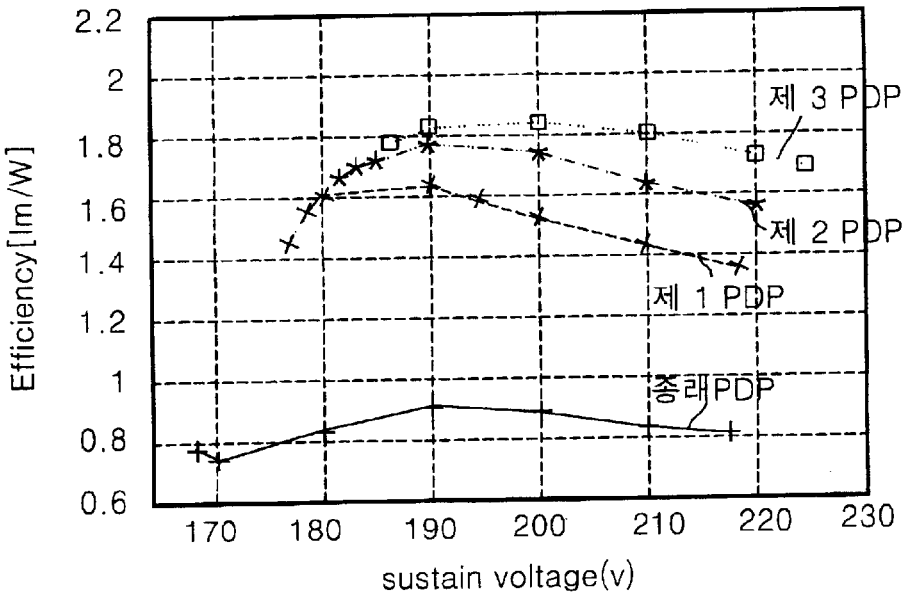
FIG. 19 is a graph for comparing an efficiency of the conventional plasma display panel with that of the second embodiment of the present invention.

FIG. 17 to FIG. 19 are graphs for comparing brightness, power consumption and efficiency of the PDP according to the second embodiment of the present invention with those of the conventional PDP.

Herein, the PDP according to the second embodiment is measured by fixing a width of the auxiliary electrode 44 to 100 μm and setting a space between the auxiliary electrode 44 and the first and second electrodes 42Y and 42Z to 60 μm (at the first PDP), 80 μm (at the second PDP) or 100 μm (at the third PDP). A distance extending from the first and second electrodes 42Y and 42Z until the boundary portion of the discharge cell is fixed to 220 μm.

In the first PDP, a voltage of the first auxiliary pulse A1 is set to −150V while voltages of the second and third auxiliary pulses A2 and A3 are set to 50V. In the second PDP, a voltage of the first auxiliary pulse A1 is set to 150V while voltages of the second and third auxiliary pulses A2 and A3 are set to 60V. In the third PDP, a voltage of the first auxiliary pulse A1 is set to −160V while voltages of the second and third auxiliary pulses A2 and A3 are set to 60V.

FIG. 17 is a graph representing a brightness value according to a variation in a sustain voltage.

Referring to FIG. 17, the PDP's according to the embodiments of the present invention have a higher brightness value than the conventional PDP. For example, when a voltage of −200V is applied to the first and second electrodes 42Y and 42Z, the second PDP has the highest brightness value and the conventional PDP has the lowest brightness value. More specifically, when a voltage of −200V is applied to the first and second electrodes 42Y and 42Z, the second PDP has a brightness value of 767 cd/m$^2$; the third PDP has a brightness value of 765 cd/m$^2$; and the first PDP has a brightness value of 688 cd/m$^2$. On the other hand, the conventional PDP have a brightness value of 348 cd/m$^2$. In other words, the PDP's according to the second embodiment of the present invention have a brightness value improved at approximately 80 to 100% in comparison to the conventional PDP.

FIG. 18 is a graph representing a power consumption value according a variation in a sustain voltage.

It can be seen from FIG. 18 that the PDP's according to the second embodiment waste greater power than the conventional PDP. For example, when a voltage of −200V is applied to the first and second electrodes 42Y and 42Z, the conventional PDP wastes about 0.000642W. On the other hand, the third PDP wastes about 0.000657W; the second PDP wastes about 0.000686W; and the first PDP wastes about 0.000693W. In other words, the PDP's according to the second embodiment have 10% higher power consumption than the conventional PDP.

FIG. 19 is a graph representing an efficiency of the PDP according to a variation in a sustain voltage.

It can be seen from FIG. 19 that the PDP's according to the second embodiment have a higher efficiency than the conventional PDP. For example, when a voltage of −200V is applied to the first and second electrodes 42Y and 42Z, the third PDP has an efficiency of 1.821 m/W; the second PDP has an efficiency of 1.731 m/W; and the first PDP has an efficiency of 1.521 m/W. On the other hand, the conventional PDP has an efficiency of 0.881 m/W. In other words, the PDP's according to the second embodiment have an efficiency improved at about 80 to 100% in comparison to the conventional PDP.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel having a plurality of discharge cells arranged in a matrix type, comprising:

a plurality of first and second electrodes provided at a rear side of an upper substrate;

a plurality of first and second bus electrodes respectively coupled to the first and second electrodes;

a dielectric layer provided over the first and second electrodes and the first and second bus electrodes; and a plurality of first and second auxiliary electrodes provided in parallel to and spaced from the first and second electrodes within the dielectric layer.

2. The plasma display panel as claimed in claim 1, wherein the plasma display panel has a luminous efficiency of at least about 1.6 lm/W at a sustain voltage of from 170 to 210 V applied to the first and second electrodes.

3. The plasma display panel as claimed in claim 1, wherein at least one first auxiliary electrode overlaps with an associated first electrode, and at least one second auxiliary electrode overlaps with an associated second electrode.

4. The plasma display panel as claimed in claim 1, wherein at least one first auxiliary electrode has a narrower width than an associated first electrode, and at least one second auxiliary electrode has a narrower width than an associated second electrode.

5. The plasma display panel as claimed in claim 4, wherein widths of the first and second auxiliary electrodes are set to 10 μm to 80 μm, and wherein the at least one first auxiliary electrode is spaced 10 μm to 40 μm from the associated first electrode, and the at least one second auxiliary electrode is spaced 10 μm to 4 μm from the associated second electrode.

6. The plasma display panel as claimed in claim 1, wherein the first electrodes are configured to provide a first sustain pulse in a sustain period, and the second electrodes are configured to provide a second sustain pulse in the sustain period, and wherein the first auxiliary electrodes are configured to provide an auxiliary pulse during the first sustain pulse, and the second auxiliary electrodes are configured to provide an auxiliary pulse during the second sustain pulse.

7. The plasma display panel as claimed in claim 1, wherein at least one first auxiliary electrode is spaced a distance X from an associated first electrode and has a width of from (⅛)X to 4X, and at least one second auxiliary electrode is spaced a distance Y from an associated second electrode and has a width of from (⅛)Y to 4Y.

8. The plasma display panel as claimed in claim 1, wherein the plasma display panel has a luminance of from about 800 to about 1400 cd/m$^2$ at a sustain voltage applied to the first and second electrodes of from 170 to 210 V.

9. The plasma display panel as claimed in claim 1, wherein the first auxiliary electrode is electrically connected to the first electrode, and the second auxiliary electrode is electrically connected to the second electrode, and at least a portion of the dielectric layer is disposed in the space between the auxiliary electrodes and the first and second electrodes.

10. A plasma display panel, comprising:

a plurality of pairs of first and second electrodes provided at a rear side of an upper substrate and in a dielectric layer; and an auxiliary electrode provided between at least one pair of first and second electrodes and in the dielectric layer, wherein the auxiliary electrode is at least partially co-planar with the first and second electrodes of the at least one pair and wherein the auxiliary electrode has a width X and is spaced a distance of from (3/7)X to (5/3)X from the first electrode of the at least one pair and a distance of from (3/7)X to (5/3)X from the second electrode of the at least one pair.

11. The plasma display panel as claimed in claim 10, wherein a width of the auxiliary electrode is set to 60 μm to 140 μm, and the auxiliary electrode is spaced 60 μm to 140 μm from the first electrode and from the second electrode of the at least one pair.

12. The plasma display panel as claimed in claim 10, wherein the first and second electrodes are adapted to selectively provide first and second sustain pulses in a sustain period, and wherein the auxiliary electrode is configured to provide an auxiliary pulse during each of the first and second sustain pulses.

13. The plasma display panel as claimed in claim 10, wherein the plasma display panel has a luminous efficiency of from about 1.4 to about 1.8 lm/W at a sustain voltage of from 175 to 225 V applied to the first and second electrodes.

14. A method of driving a plasma display panel including first and second electrodes provided at an upper substrate, and an auxiliary electrode provided in parallel to the first and second electrodes, said method comprising:

alternately applying first and second sustain pulses to the first and second electrodes in a sustain period; and applying a first auxiliary pulse to the auxiliary electrode during each of the first and second sustain pulses.

15. The method as claimed in claim 14, further comprising:

applying a second auxiliary pulse between the first sustain pulses; and applying a third auxiliary pulse between the second sustain pulses alternated with the second auxiliary pulse.

16. The method as claimed in claim 15, wherein the second auxiliary pulse is applied simultaneously with the first auxiliary pulse supplied between the first sustain pulses, and the third auxiliary pulse is applied simultaneously with the first auxiliary pulse supplied between the second sustain pulses.

17. The method as claimed in claim 15, wherein the first to third auxiliary pulses have the same pulse width.

18. The method as claimed in claim 15, wherein the first to third auxiliary pulses have narrower pulse widths than the first and second sustain pulses.

19. The method as claimed in claim 18, wherein said pulse widths of the first to third auxiliary pulses are set to 0.5 μs to 1.5 μs.

20. The method as claimed in claim 19, wherein said pulse widths of the first to third auxiliary pulses are set to 0.6 μs to 1.0 μs.

21. The method as claimed in claim 15, wherein the first auxiliary pulse has a voltage value of −150 V to −170V.

22. The method as claimed in claim 15, wherein each of the second and third auxiliary pulses has a voltage value of 50V to 60V.

* * * * *